US010279230B2

(12) United States Patent
Abe et al.

(10) Patent No.: US 10,279,230 B2
(45) Date of Patent: May 7, 2019

(54) GOLF CLUB HEAD

(71) Applicant: DUNLOP SPORTS CO. LTD., Kobe-shi, Hyogo (JP)

(72) Inventors: Hiroshi Abe, Kobe (JP); Naruhiro Mizutani, Kobe (JP); Daisuke Kohno, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/157,855

(22) Filed: May 18, 2016

(65) Prior Publication Data

US 2016/0361612 A1 Dec. 15, 2016

(30) Foreign Application Priority Data

Jun. 9, 2015 (JP) ..... 2015-117060

(51) Int. Cl.
*A63B 53/06* (2015.01)
*A63B 53/04* (2015.01)
(Continued)

(52) U.S. Cl.
CPC ..... *A63B 53/06* (2013.01); *A63B 53/0466* (2013.01); *A63B 60/02* (2015.10);
(Continued)

(58) Field of Classification Search
CPC .... A63B 2053/0491; A63B 2053/0433; A63B 2053/0466
(Continued)

(56) References Cited

U.S. PATENT DOCUMENTS 4,147,349 A * 4/1979 Jeghers ..... A63B 53/04 473/291
4,247,105 A * 1/1981 Jeghers ..... A63B 53/04 473/291
(Continued)

FOREIGN PATENT DOCUMENTS

JP 2000-24149 A 1/2000
JP 2001-149514 A 6/2001
(Continued)

OTHER PUBLICATIONS

Japanese Notification of Reasons for Refusal for Japanese Application No. 2015-117060, dated Sep. 11, 2018, with English translation.

*Primary Examiner* — William M Pierce
(74) *Attorney, Agent, or Firm* — Birch, Stewart, Kolasch & Birch, LLP

(57) ABSTRACT

Provided is a golf club head that is able to suppress lowering of the pitch of a ball hitting sound. The golf club head according to the present invention includes a crown portion, a face portion, and a sole portion having at least one recessed portion. The recessed portion is configured to house a weight member such that the weight member does not protrude externally. The sole portion is provided with a placement region connected to the face portion and to be at least partially placed on a placement surface in a reference state, and a rear region arranged further to a back side in a face-back direction than the placement region and in which the recessed portion is arranged. The rear region inclines upward relative to the placement region toward the back side.

14 Claims, 10 Drawing Sheets

(51) Int. Cl.
*A63B 60/02* (2015.01)
*A63B 71/06* (2006.01)
*A63B 60/00* (2015.01)

(52) U.S. Cl.
CPC ..... *A63B 2053/0433* (2013.01); *A63B 2053/0491* (2013.01); *A63B 2060/002* (2015.10); *A63B 2071/0694* (2013.01)

(58) Field of Classification Search
USPC ..... 473/334–339, 349
See application file for complete search history.

(56) References Cited

U.S. PATENT DOCUMENTS 4,653,756 A * 3/1987 Sato ..... A63B 53/04 473/327
4,883,273 A * 11/1989 Kobayashi ..... A63F 9/00 273/110
6,093,112 A * 7/2000 Peters ..... A63B 53/00 473/291
6,277,032 B1 * 8/2001 Smith ..... A63B 53/04 473/336
6,497,628 B1 * 12/2002 Gunderson ..... A63B 53/02 473/313
7,614,962 B1 * 11/2009 Clausen ..... A63B 53/047 473/291
8,257,196 B1 * 9/2012 Abbott ..... A63B 53/0466 473/335
8,696,491 B1 * 4/2014 Myers ..... A63B 53/06 473/334
8,753,225 B1 * 6/2014 Abbott ..... A63B 53/06 473/334
9,387,373 B1 * 7/2016 DeMille ..... A63B 53/0466
9,415,280 B2 * 8/2016 Stokke ..... A63B 53/0466
2003/0232659 A1 * 12/2003 Mahaffey ..... A63B 53/0466 473/256
2005/0075185 A1 * 4/2005 Green ..... A63B 53/0487 473/240
2005/0277486 A1 * 12/2005 Hyman ..... A63B 53/047 473/340
2006/0089206 A1 * 4/2006 Lo ..... A63B 53/04 473/334
2006/0122004 A1 * 6/2006 Chen ..... A63B 53/0466 473/335
2006/0178228 A1 * 8/2006 DiMarco ..... A63B 53/0466 473/334
2006/0240908 A1 * 10/2006 Adams ..... A63B 53/0466 473/334
2006/0258480 A1 * 11/2006 Hou ..... A63B 53/04 473/332
2007/0004534 A1 * 1/2007 Lee ..... A63B 53/0487 473/340
2007/0054751 A1 * 3/2007 Breier ..... A63B 53/0466 473/334
2007/0178988 A1 * 8/2007 Tavares ..... A63B 53/04 473/334
2007/0238551 A1 * 10/2007 Yokota ..... A63B 53/0466 473/349
2008/0058119 A1 * 3/2008 Soracco ..... A63B 53/04 473/350
2008/0194354 A1 * 8/2008 Nagai ..... A63B 53/0466 473/334
2008/0261715 A1 * 10/2008 Carter ..... A63B 53/0466 473/291
2009/0203462 A1 * 8/2009 Stites ..... A63B 53/0466 473/334
2011/0009209 A1 * 1/2011 Llewellyn ..... A63B 53/0466 473/336
2012/0083360 A1 * 4/2012 Boyd ..... A63B 53/0466 473/337
2012/0122601 A1 * 5/2012 Beach ..... A63B 53/02 473/248
2012/0129625 A1 * 5/2012 Rice ..... A63B 53/0466 473/335
2012/0157222 A1 * 6/2012 Kii ..... A63B 53/00 473/290
2012/0196702 A1 * 8/2012 Shimazaki ..... A63B 53/047 473/345
2013/0017903 A1 * 1/2013 Takechi ..... A63B 53/047 473/332
2013/0281227 A1 * 10/2013 Roach ..... A63B 53/0475 473/332
2013/0320072 A1 * 12/2013 Yamamoto ..... B23K 37/04 228/212
2013/0324295 A1 * 12/2013 Oldknow ..... A63B 53/0466 473/327
2013/0331201 A1 * 12/2013 Wahl ..... A63B 53/0475 473/329
2013/0344988 A1 * 12/2013 Hettinger ..... A63B 53/047 473/349
2013/0344989 A1 * 12/2013 Hebreo ..... A63B 53/047 473/349
2014/0113739 A1 * 4/2014 Jertson ..... A63B 53/04 473/291
2014/0274460 A1 * 9/2014 Schweigert ..... A63B 53/0466 473/345
2014/0349779 A1 * 11/2014 Mizutani ..... A63B 53/06 473/335
2014/0349780 A1 * 11/2014 Fossum ..... A63B 53/0466 473/345
2015/0031470 A1 * 1/2015 Matsunaga ..... A63B 53/06 473/324
2015/0057096 A1 * 2/2015 Nicolette ..... A63B 53/047 473/290
2015/0217364 A1 * 8/2015 Zimmerman ..... B21K 17/00 72/352
2015/0273287 A1 * 10/2015 Doi ..... A63B 53/047 473/350
2015/0297961 A1 * 10/2015 Voshall ..... A63B 53/06 473/335
2015/0306475 A1 * 10/2015 Curtis ..... A63B 53/06 473/337
2015/0321055 A1 * 11/2015 Golden ..... A63B 53/0466 473/338
2015/0343279 A1 * 12/2015 Mizutani ..... A63B 53/02 473/307
2016/0001146 A1 * 1/2016 Sargent ..... A63B 53/06 473/336
2016/0023064 A1 * 1/2016 Larson ..... A63B 53/0466 473/350
2016/0059093 A1 * 3/2016 Nielson ..... A63B 53/02 473/338
2016/0074720 A1 * 3/2016 Kline ..... A63B 53/06 473/223
2016/0101330 A1 * 4/2016 Harrington ..... A63B 53/047 473/338
2016/0144248 A1 * 5/2016 Chen ..... A63B 53/047 473/350
2016/0184669 A1 * 6/2016 Deshmukh ..... A63B 53/0475 473/335
2016/0325155 A1 * 11/2016 Llewellyn ..... A63B 53/0466
2016/0354653 A1 * 12/2016 Aramaki ..... A63B 53/0466
2016/0354655 A1 * 12/2016 Kato ..... A63B 53/0466
2016/0354656 A1 * 12/2016 Kato ..... A63B 53/0466
2017/0072277 A1 * 3/2017 Mata ..... A63B 53/06

FOREIGN PATENT DOCUMENTS

JP 2015-29833 A * 2/2012
JP 2015-29833 A 2/2015

* cited by examiner

Cross-section E1

I Fig. 4B
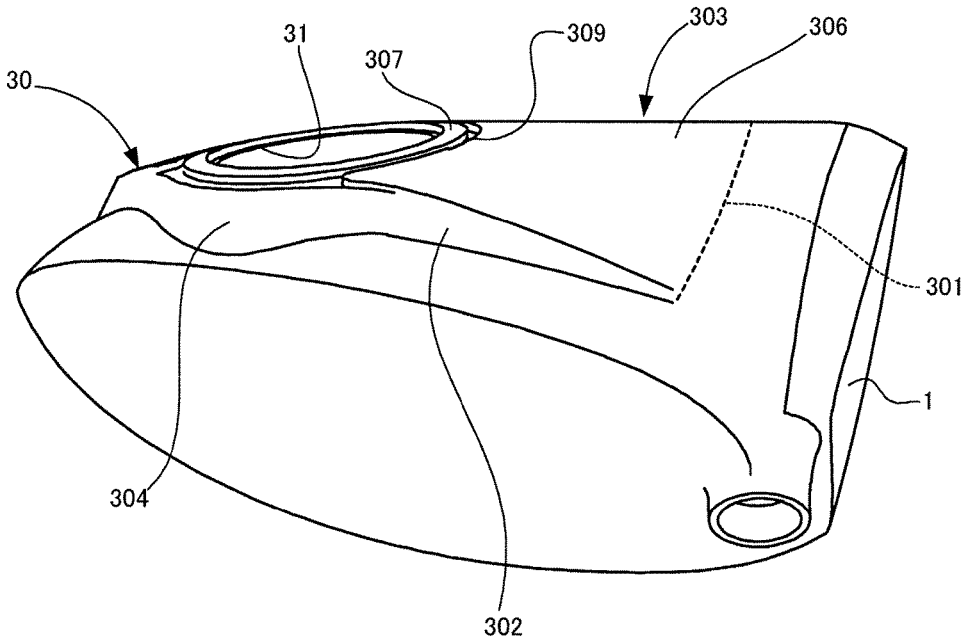
II Fig. 4C
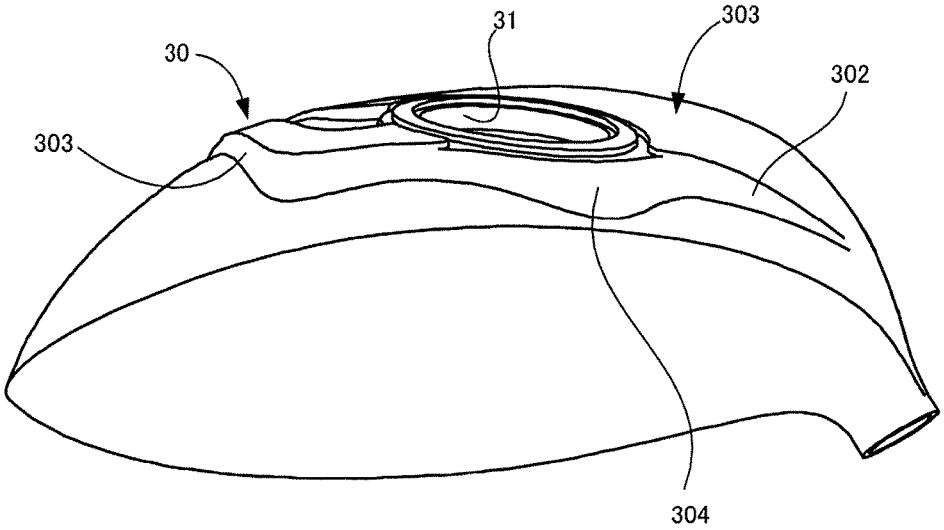

III Fig. 4D
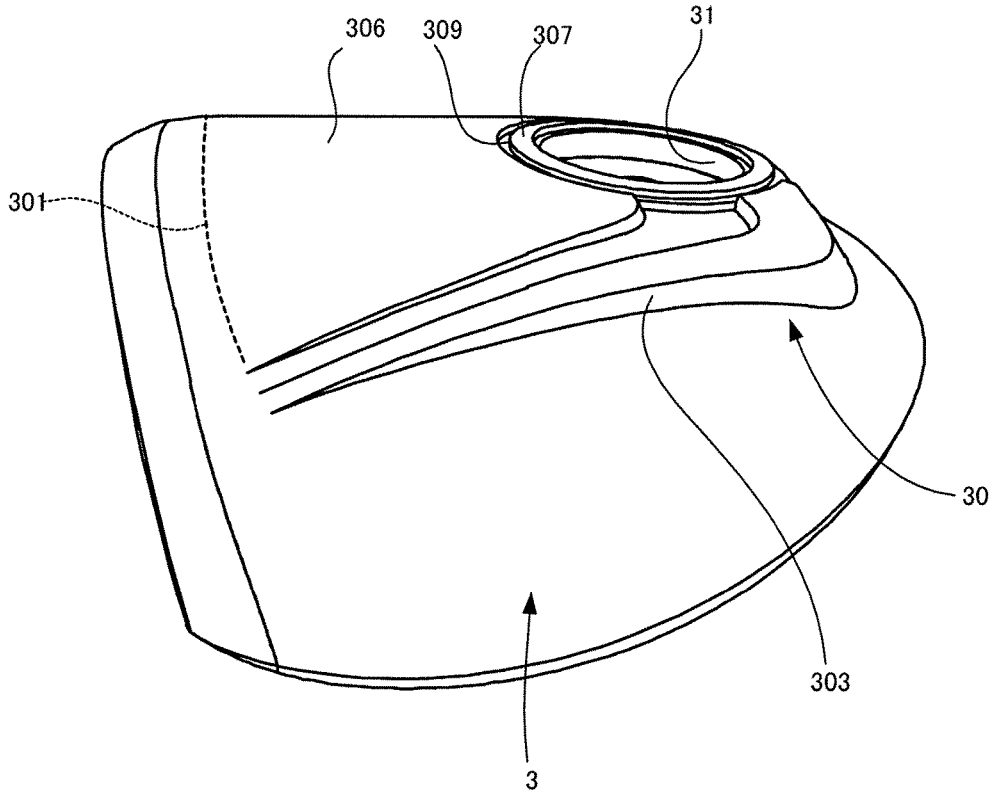

(b)

(a)

GOLF CLUB HEAD

CROSS REFERENCE TO RELATED APPLICATION

This application claims a priority to Japanese Patent Application No. 2015-117060 filed on Jun. 9, 2015, which is hereby incorporated by reference in its entirety.

FIELD OF INVENTION

The present invention relates to a golf club head.

BACKGROUND OF THE INVENTION

JP 2015-29833A proposes a golf club head in which a recessed portion is formed in a sole portion and a weight member can be removably attached in the recessed portion.

Incidentally, with a golf club head such as the above, the sole portion vibrates due to the impact of hitting the ball, and this contributes to the ball hitting sound. Specifically, the frequency of the vibration of the sole portion affects the pitch of the ball hitting sound. In the case where a weight member such as above is provided in the sole portion, the amplitude of the sole portion increases when vibrating, and the frequency of the vibration thereby decreases. The problem of the pitch of the ball hitting sound being lowered occurs as a result. The present invention was made in order to resolve this problem, and an object thereof is to provide a golf club head that is able to suppress lowering of the pitch of the ball hitting sound.

SUMMARY OF INVENTION

A golf club head according to the present invention includes a crown portion, a face portion, and a sole portion having at least one recessed portion. The recessed portion is configured to house a weight member such that the weight member does not protrude externally, the sole portion includes a placement region connected to the face portion and to be at least partially placed on a placement surface in a reference state, and a rear region arranged further to a back side in a face-back direction than the placement region and in which the recessed portion is arranged, and the rear region inclines upward relative to the placement region toward the back side.

In the above golf club head, the rear region can be inclined at an angle of 4 to 10 degrees relative to the placement region.

In each of the above golf club heads, a configuration can be adopted in which at least a part of the placement region and the rear region integrally protrude downward.

In each of the above golf club heads, the placement region can be formed to have a flat shape.

Each of the aforementioned golf club heads can further include a weight member and a decoration member that are to be arranged in the recessed portion, and the decoration member can be fixed in the recessed portion by the weight member.

In each of the above golf club heads, the recessed portion can be arranged further to the back side and to a heel side in a toe-heel direction than a center of gravity of the golf club head.

A golf club head according to an one aspect of embodiment enables lowering of the pitch of the ball hitting sound to be suppressed.

BRIEF DESCRIPTION OF DRAWINGS

FIG. 4B is a perspective view along the direction of arrow I, FIG. 4C is a perspective view along the direction of arrow IL and FIG. 4D is a perspective view along the direction of arrow III;

DETAILED DESCRIPTION OF THE PREFERRED EMBODIMENTS

Figure 1:
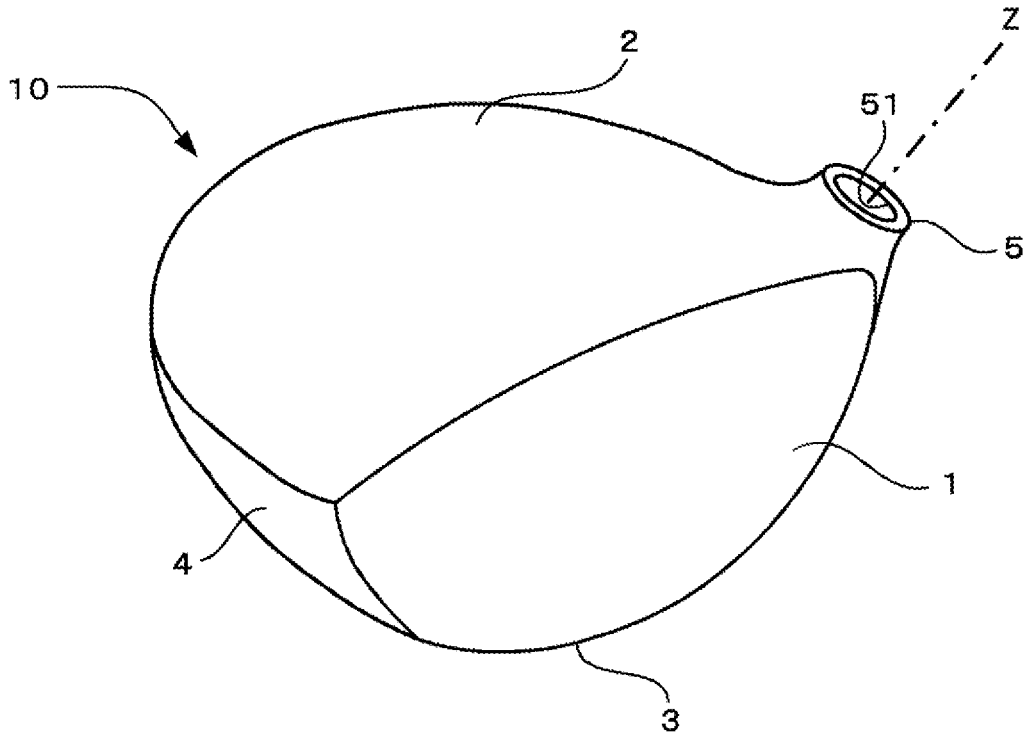
FIG. 1 is a perspective view of a reference state in one embodiment of a golf club head according to the present invention.
Figure 2:
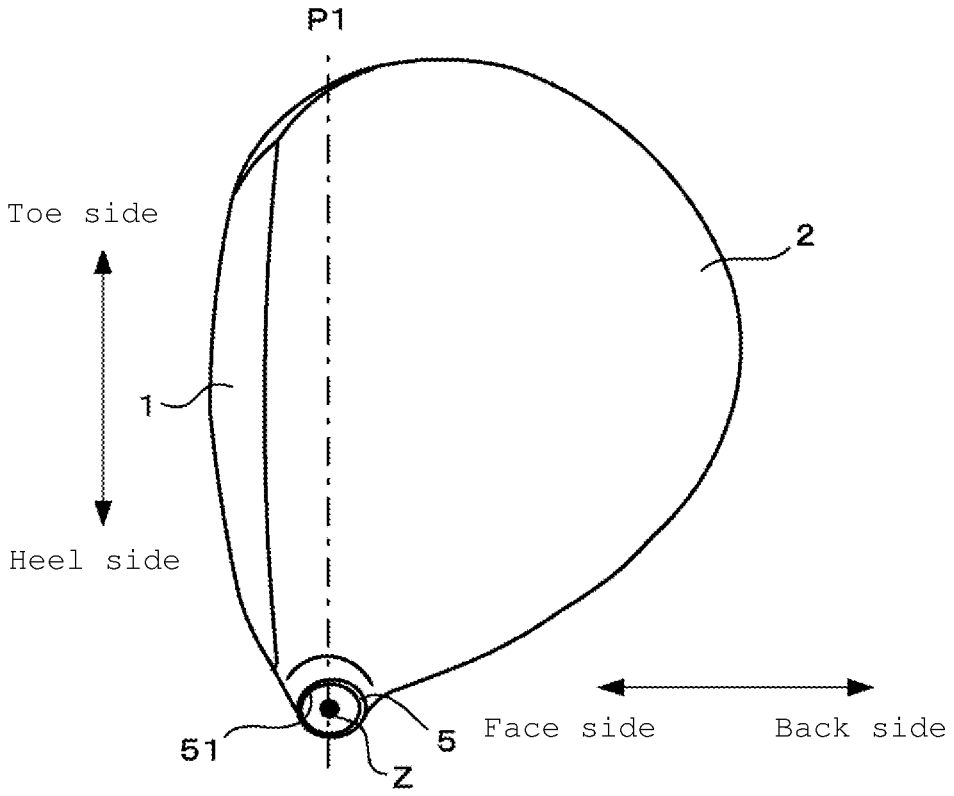
FIG. 2 is a plan view of FIG. 1.

An embodiment of a golf club head according to the present invention will be described below with reference to the drawings. FIG. 1 is a perspective view of the golf club head according to the present embodiment, and FIG. 2 is a plan view of FIG. 1. Hereinafter, an overview of the golf club head will be described first, and then a decoration member and a fixing member provided to the golf club head will be described.

1. OVERVIEW OF GOLF CLUB HEAD

As shown in FIG. 1, this golf club head (hereinafter, may be referred to as simply the "head") 10 is a wood-type golf club head having a hollow structure with an internal space, and wall surfaces thereof are formed by a face portion 1, a crown portion 2, a sole portion 3, a side portion 4, and a hosel portion 5.

The face portion 1 has a face surface, which is the surface that hits the ball, and the crown portion 2 is adjacent to the face portion 1 and constitutes the upper surface of the head. The sole portion 3 constitutes the bottom surface of the head, and is adjacent to the face portion 1 and the side portion 4. Also, the side portion 4 is the region between the crown portion 2 and the sole portion 3, and extends from the toe side of the face portion 1 to the heel side of the face portion 1 across the back side of the head. Furthermore, the hosel portion 5 is the region provided adjacent to the heel side of the crown portion 2, and has an insertion hole 51 for insertion of the shaft (not shown) of the golf club. A central axis Z of the insertion hole 51 coincides with the axis of the shaft.

The following describes the aforementioned reference state. First, as shown in FIGS. 1 and 2, a state in which the central axis Z is in a plane P1 that is perpendicular to a ground H (placement surface; see FIG. 5) and the head is placed on the ground at a predetermined lie angle and real loft angle is prescribed as the reference state. The plane P1 will be referred to as a reference perpendicular plane. Also, as shown in FIG. 2, the direction of the line of intersection of the reference perpendicular plane P1 and the ground will be referred to as the toe-heel direction, and the direction that is perpendicular to the toe-heel direction and parallel to the ground will be referred to as the face-back direction.

Figure 3A:
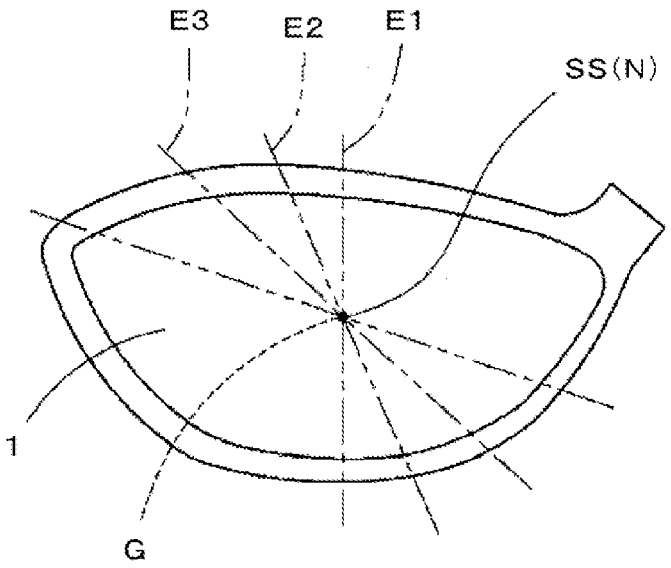
FIGS. 3A and 3B are diagrams illustrating a boundary of a face portion.
Figure 3B:
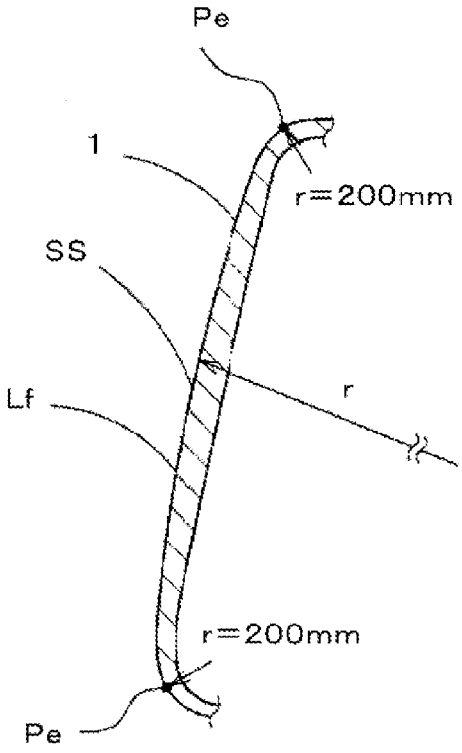
Figure 4A:
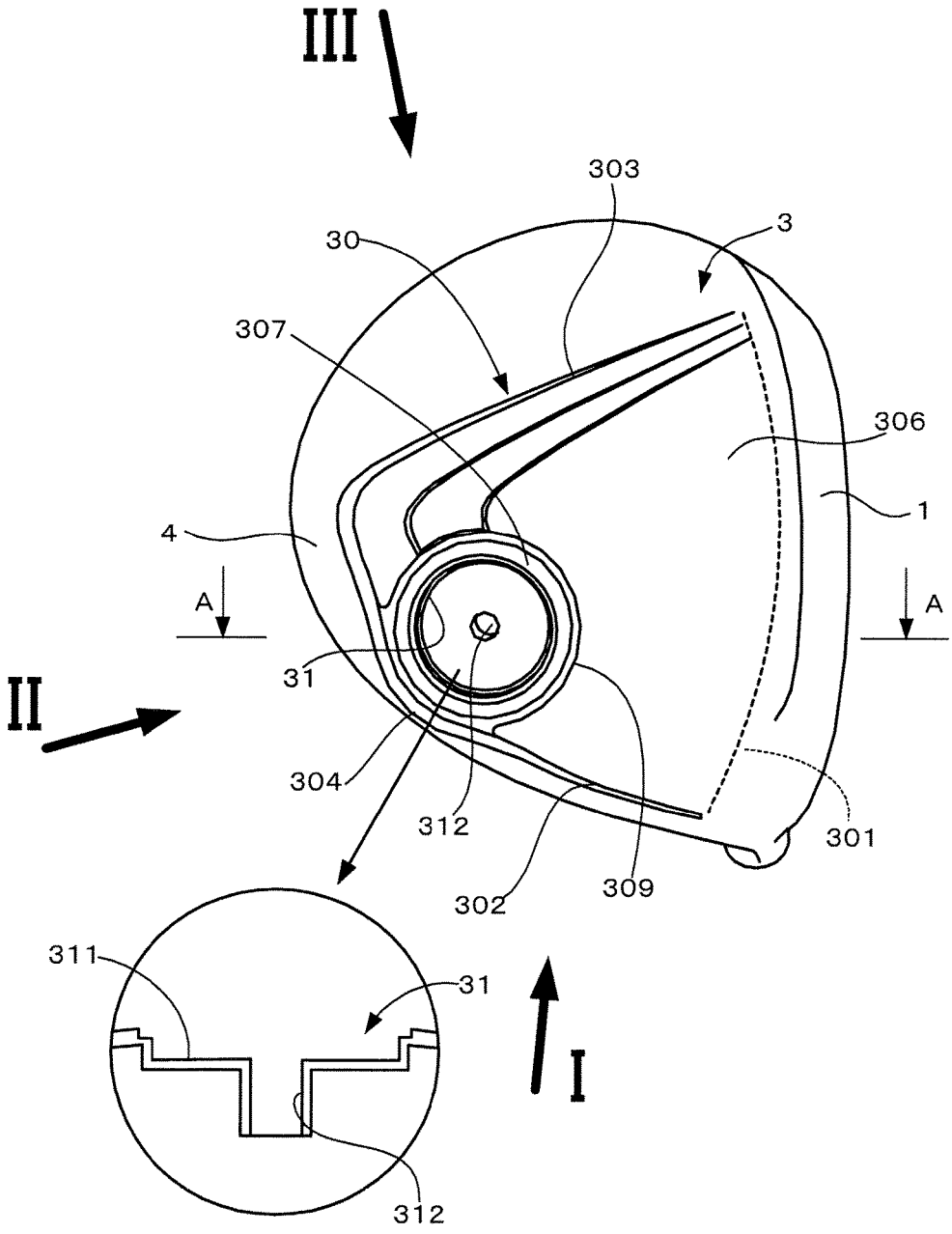
FIG. 4A is a bottom view of FIG. 1.

In the present embodiment, the boundary between the crown portion 2 and the side portion 4 can be defined as follows. Specifically, if a ridge line is formed between the crown portion 2 and the side portion 4, that ridge line serves as the boundary. In contrast, if a clear ridge line is not formed, the boundary is the outline that is seen when the head is placed in the reference state and viewed from directly above the center of gravity of the head. Similarly, in the case of the boundary between the face portion 1 and the crown portion 2 and between the face portion 1 and the sole portion 3, if a ridge line is formed, that ridge line serves as the boundary. However, if a clear ridge line is not formed, the peripheral edge (boundary) of the face portion 1 is defined by positions Pe where, in each cross-section E1, E2, E3 and so on that include a straight line N connecting the center of gravity G of the head and a sweet spot SS as shown in FIG. 3A, a radius of curvature r of an outline Lf of the outer surface of the face first reaches 200 mm when moving to face outward from the sweet spot side as shown in FIG. 3B. Note that the sweet spot SS is the intersection between the face surface and a normal line (straight line N) of the face surface that passes through the center of gravity G of the head.

Also, in the present embodiment, the boundary between the sole portion 3 and the face portion 1 and between the sole portion 3 and the side portion 4 can be defined as follows. Specifically, if a ridge line is formed between the sole portion 3 and the face portion 1 and between the sole portion 3 and the side portion 4, that ridge line serves as the boundary. Also, although the golf club head according to the present embodiment has the side portion 4, in cases such as where, for example, the side portion 4 is not provided, the side portion 4 cannot be clearly distinguished and is included in the sole portion 3, or the sole portion 3 is directly connected to the crown portion 2, the ridge line between the sole portion 3 and the crown portion 2 serves as the boundary between both portions. Also, if a clear ridge line is not formed, the boundary is the outline that is seen when the head is placed in the reference state and viewed from directly above the center of gravity of the head 10. Note that, in consideration of the case where the side portion cannot be clearly distinguished as described above, the "sole portion" according to the present invention is deemed to include the side portion.

Next, the sole portion will be described. As shown in FIGS. 4A-4D, a raised portion 30 protruding downward is formed on the sole portion 3. To be more specific, the raised portion 30 has a generally triangular shape formed by a first edge portion 301 that extends along generally the entirety of the face portion 1, along the vicinity of the boundary between the face portion 1 and the sole portion 3, a second edge portion 302 that extends from the vicinity of the hosel portion 5 to the vicinity of a midpoint in the toe-heel direction, along the vicinity of the boundary with the side portion 4 (or the crown portion 2), and a third edge portion 303 that extends diagonally to join an end portion of the first edge portion 301 on the toe side and an end portion of the second edge portion 302 on the toe side. To be more specific, either a step is not formed or only a slight step is formed in the first edge portion 301. In contrast, a clear step is formed in the second edge portion 302 and the third edge portion 303, and the steps are formed so as to increase in height, particularly toward the back side. Also, the height of the rise in the second edge portion 302 and the third edge portion 303 can be 1 to 10 mm, for example. Accordingly, if the first edge portion 301 does not have a step, the first edge portion 301 can, for example, be a line that runs generally along the boundary between the face portion 1 and the sole portion 3 to join the end portions of the second edge portion 302 and the third edge portion 303. Note that, if the side portion 4 is not clearly formed, the second edge portion 302 can be an edge portion formed along the vicinity of the boundary between the sole portion 3 and the crown portion 2. Also, even if the side portion 4 is formed, the second edge portion 302 can also be formed to run along the boundary with the crown portion 2.

A circular recessed portion 31 is formed inside the raised portion 30. As described below, a decoration member 6 and a fixing member 7 for fixing this decoration member 6 in the recessed portion 31 are arranged in the recessed portion 31. Also, in order to fix the fixing member 7 in the recessed portion 31, a fixing hole 312 in which a female thread is formed is provided in the center of a bottom surface 311 of the recessed portion 31. The position of the fixing hole 312 is arranged further to the back side in the face-back direction and to the heel side in the toe-heel direction than the center of gravity of the head. Furthermore, a part of the peripheral edge of the recessed portion 31 protrudes from the second edge portion 302 toward the heel side, and accordingly an arc-shaped protruding portion 304 that constitutes part of the peripheral edge of the recessed portion 31 is formed in the second edge portion 302.

Figure 5:
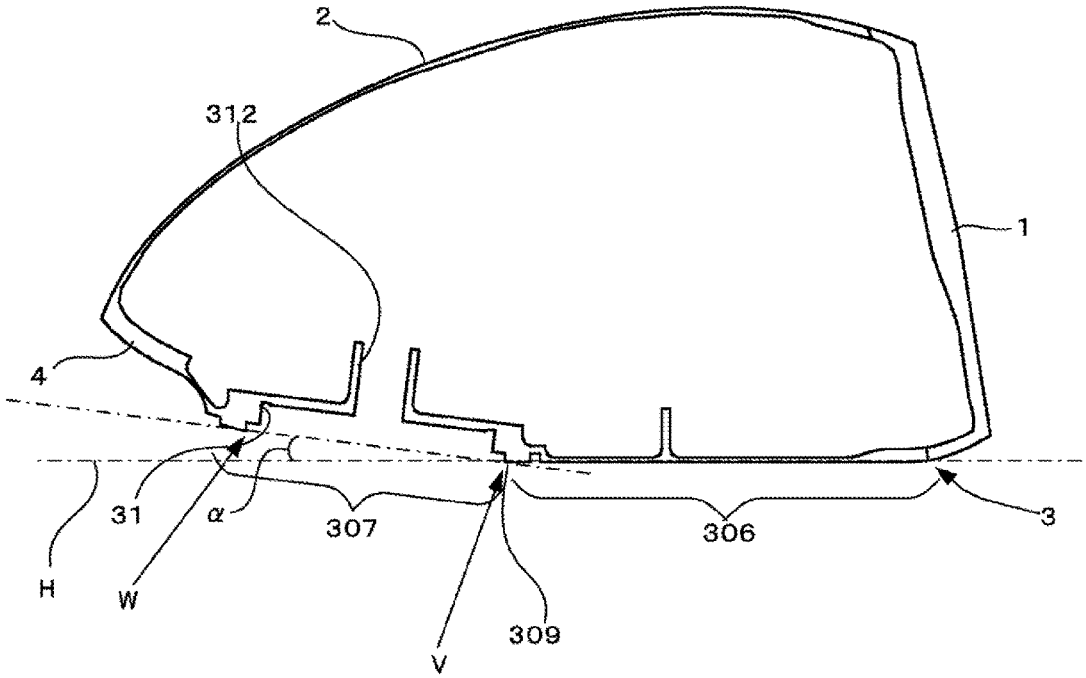
FIG. 5 is a cross-sectional view along an A-A line in FIG. 4A (cross-sectional view in a face-back direction passing through the center of a recessed portion)

Also, as shown in FIGS. 4 and 5, at least two regions are formed in the raised portion 30. Specifically, the regions include a placement region 306 that is connected to the face portion 1 and is placed on the ground H in the reference state, and a rear region 307 that is arranged further to the back side in the face-back direction than the placement region 306 and in which the recessed portion 31 is arranged. As described above, the placement region 306 is placed on the ground H, and is thus a flat region extending in at least the face-back direction from the vicinity of the boundary with the face portion 1 to the vicinity of the recessed portion 31. Also, as described above, the recessed portion 31 is formed in the rear region 307, and a boundary 309 between the placement region 306 and the rear region 307 is formed in an arc shape so as to run along the peripheral edge of the recessed portion 31 in the vicinity of the face portion 1 side of the recessed portion 31.

Thus, the rear region 307 extends so as to incline from the boundary 309 toward the back side. Specifically, the rear region 307 inclines so as to be oriented upward toward the back side. At this time, the rear region 307 and the placement region 306 are preferably connected so as to intersect each other at an angle $\alpha$ of approximately 4 to 10°. This is because, as described below, rigidity decreases if the angle $\alpha$ is less than 4°, and the center of gravity of the sole portion 3 is raised if the angle $\alpha$ is more than 10°. Note that the angle $\alpha$ is assumed to be measured in a cross-section passing through the center 312 of the recessed portion 31 and extending in the face-back direction, and the rear region 307 is assumed to run along a straight line passing through the both ends (points V and W in FIG. 5) of the recessed portion 31 in this cross-section.

The raised portion 30 is mainly arranged on the heel portion side of the sole portion 3, and when the head 10 in the reference state is seen in back view, at least 60% of the area of the raised portion 30 can be arranged further to the heel side than a line extending in the face-back direction through the furthest point on the back side of the sole portion 3. Note that the furthermost point on the back side of the sole portion 3 is specified from the outline of the head in the reference state when seen in back view.

The volume of this golf club head is, for example, preferably 300 $cm^3$ or more, more preferably 400 $cm^3$ or more, and particularly preferably 420 $cm^3$ or more. Ahead having such a volume serves to make the golfer feel more confident when the club is held at address, and also to increase the sweet spot area and the moment of inertia. Note that although an upper limit of the head volume is not particularly defined, in terms of practical use, it is, for example, desirably 500 $cm^3$ or less, and desirably 470 $cm^3$ or less when complying with R&A or USGA rules and regulations.

Also, the head can be formed from, for example, a titanium alloy (e.g., Ti-6Al-4V) having a specific gravity of approximately 4.4 to 4.5. Besides a titanium alloy, the head 10 can be formed from one or a plurality of materials selected from among stainless steel, maraging steel, an aluminum alloy, a magnesium alloy, an amorphous alloy, and the like. Such a golf club head can be produced using various methods, and can, for example, be manufactured by casting using a known lost wax precision casting method or the like.

Note that the head according the present embodiment is configured by assembling a head body that has at least the sole portion 3 and another portion. For example, the head can be configured by constituting only the face portion 1 as a separate member and attaching the face portion 1 to the head body, or alternatively, the head can be configured by forming a head body with an opening provided in the crown portion 2 or the side portion 4 and blocking the opening with a separate member. Also, a cup face structure provided with a peripheral edge portion surrounding the face portion 1 can be employed.

2. FIXING MEMBER

Figure 6A:
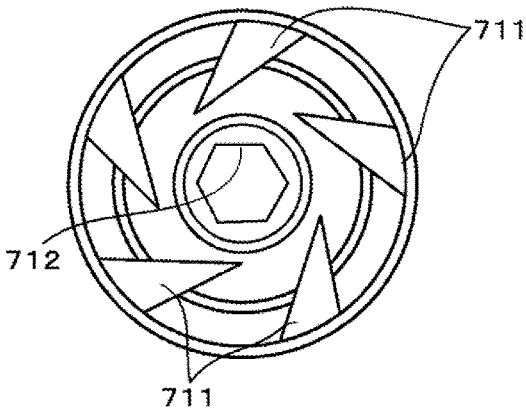
FIG. 6A is a plan view and FIG. 6B is a cross-sectional view of a fixing member.
Figure 6B:
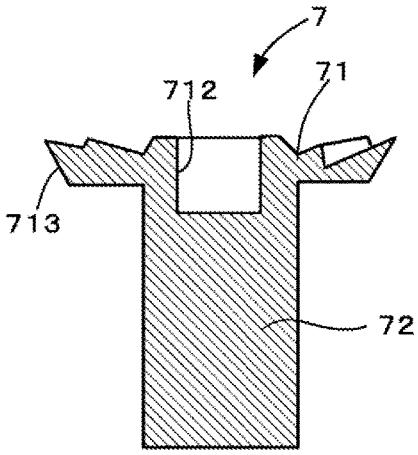

Next, the fixing member 7 will be described with reference to FIGS. 6A and 6B. FIG. 6A is a plan view and FIG. 6B is a cross-sectional view of the fixing member. For ease of description, the following description is based on the up-down direction in the drawings, but this direction does not necessarily limit the present invention. This point also applies to the following description of the decoration member 6 and attachment thereof.

As shown in FIGS. 6A and 6B, the fixing member 7 includes a disk-shaped head portion 71 and a shaft portion 72 that extends from the lower surface of the head portion 71. Also, the upper surface of the head portion 71 has been decorated. Specifically, on the upper surface of the head portion 71, a plurality of triangular recessed portions 711 that extend inward in the diameter direction from an outer peripheral edge thereof are formed at equal intervals. Also, at the center of the upper surface of the head portion 71, a tool hole 712 for inserting a tool such as a hex wrench or the like is formed. Furthermore, an outer peripheral surface 713 of the head portion 71 is formed with a taper whose diameter decreases downward. On the other hand, the shaft portion 72 is formed to have a columnar shape, and a male thread is formed on the outer peripheral surface thereof. This shaft portion 72 is configured to screw into the female thread of the fixing hole 312 of the recessed portion 31 formed in the aforementioned sole portion 3.

The material forming the fixing member 7 is not particularly limited, and a metal such as aluminum or stainless steel, a resin material or the like can be used, for example. Also, this fixing member 7 is used as a weight for adjustment. Specifically, a plurality of types of differently weighted fixing members 7 with substantially the same shape are prepared. The weight and the center of gravity of the head can then be changed by using one of the plurality of types of fixing members 7.

3. DECORATION MEMBER

Next, the decoration member 6 will be described with reference to FIGS. 7A and 7B. FIG. 7A is a plan view and FIG. 7B is a cross-sectional view of the decoration member.

Figure 7B:
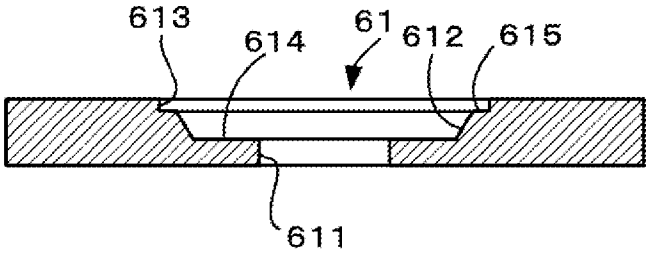
FIG. 7A is a plan view and FIG. 7B is a cross-sectional view of a decoration member.
Figure 7A:
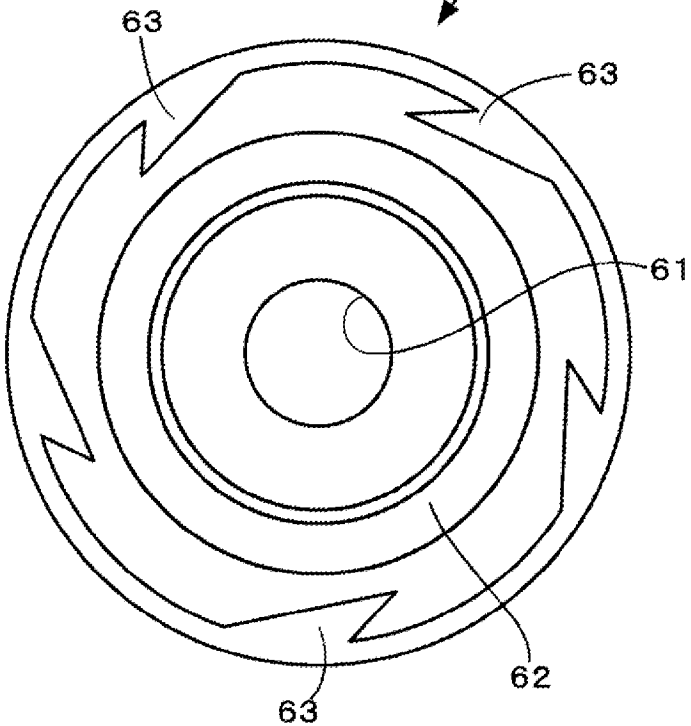

As shown in FIGS. 7A and 7B, the decoration member 6 is provided in order to decorate the sole portion 3. The decoration member 6 is formed to have a circular plate shape, and a through hole 61 is formed in the center thereof. The outer diameter of the decoration member 6 substantially matches the inner diameter of the recessed portion 31 of the sole portion 3, and the central through hole 61 is arranged in a position corresponding to the fixing hole 312 of the recessed portion 31. The upper surface of the decoration member 6 has been decorated, and decoration is possible with various methods. For example, decoration can be performed by coloring or forming a pattern with irregularities. In the example shown in FIGS. 7A and 7B, a ring 62 is formed around the through hole 61 and a plurality of triangular protruding portions 63 that extend inward in the diameter direction from an outer peripheral edge of the upper surface of the decoration member 6 form a pattern. A pattern is then formed on the upper surface of the decoration member 6 by shaving down the region excluding the ring 62 and the protruding portions 63 to form a recessed portion. Note that the protruding portions 63 of the decoration member 6 correspond to the recessed portions 711 of the fixing member 7, and achieve commonality in the pattern.

The through hole 61 is formed in order to attach the fixing member 7, and is constituted by three cylindrical regions. Specifically, the through hole 61 is constituted by a first portion 611 into which the shaft portion 72 of the fixing member 7 is to be inserted, a second portion 612 having a larger diameter than the first portion 611 and in which the head portion 71 is to be arranged, and a third portion 613 having a larger diameter than the second portion 612 and forming a gap on the peripheral edge of the head portion 71, and the first to third portions 611 to 613 are formed in the stated order so as to be continuous from the lower side to the upper side of the through hole 61.

The first portion 611 is formed with a slightly larger diameter than the shaft portion 72 of the fixing member 7. The second portion 612 has a larger diameter than the diameter of the first portion 611, and thus a first step portion 614 is formed between the second portion 612 and the first portion 611, and the lower surface of the head portion 71 of the fixing member 7 is configured to be placed on this first step portion 614. At this time, the depth of the first step portion 614 is prescribed such that the upper surface of the head portion 71 and the upper surface of the decoration member 6 are arranged generally on the same plane. Also, the inner wall surface of the second portion 612 is formed with a taper whose diameter decreases downward, and corresponds to the taper of the outer peripheral surface 713 of the head portion 71 of the fixing member 7.

The third portion 613 is formed with a slightly larger diameter than the diameter of the second portion 612, and when the head portion 71 of the fixing member 7 is mounted in the decoration member 6, the third portion 613 forms a gap on the peripheral edge of the head portion 71 of the fixing member 7. Specifically, a gap D is formed between the outer peripheral surface 713 of the head portion 71 and the inner wall surface of the third portion 613 (see FIG. 8). The width of the gap D is not particularly limited, and can be 0.1 to 2.0 mm, and more preferably 0.2 to 1.5 mm, for example. Also, a second step portion 615 is formed between the third portion 613 and the second portion 612, and this second step portion 615 is configured to be located at an intermediate portion of the mounted head portion 71 in the up-down direction.

The material forming the decoration member 6 is not particularly limited, and the decoration member 6 can also be formed with a metal such as stainless steel or aluminum, a resin material or the like, for example. Also, similarly to the fixing member 7, the decoration member 6 can be used as a weight for adjustment.

4. ATTACHMENT OF FIXING MEMBER AND DECORATION MEMBER

Figure 8:
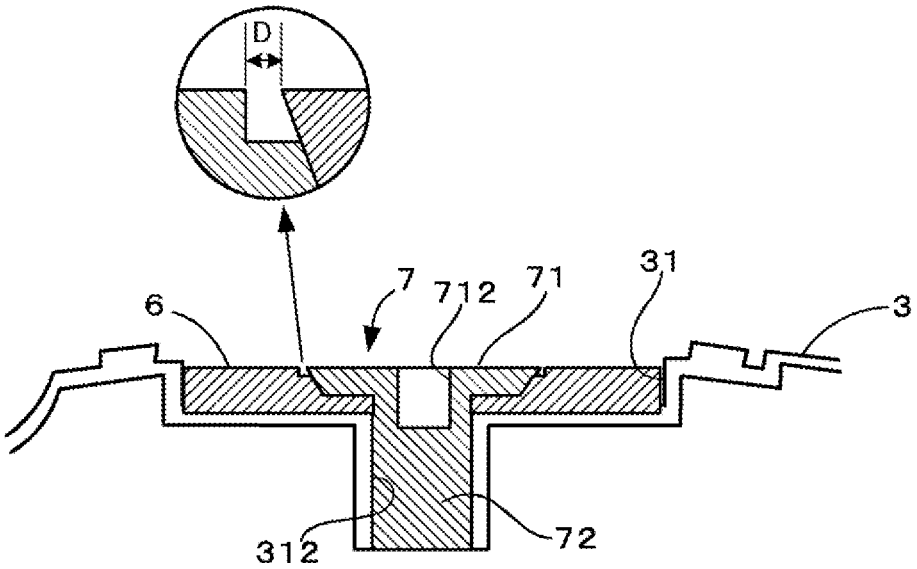
FIG. 8 is a cross-sectional view showing a state where the decoration member and the fixing member are attached to the sole portion.
Figure 9:
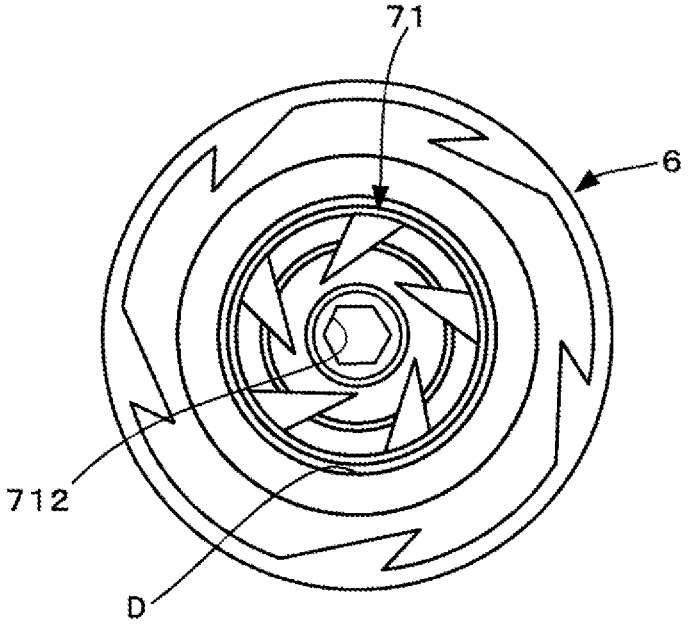
FIG. 9 is a plan view of FIG. 8.

Next, attachment of the fixing member and the decoration member will be described with reference to FIGS. 8 and 9. FIG. 8 is a cross-sectional view showing a state where the decoration member and the fixing member are attached to the sole portion, and FIG. 9 is a plan view of FIG. 8.

First, after an adhesive is applied to the lower surface of the decoration member 6, the decoration member 6 is arranged in the recessed portion 31 of the sole portion 3. Then, the fixing member 7 is arranged in the through hole 61 of the decoration member 6, and a hex wrench is inserted into the tool hole 712 of the upper surface of the fixing member 7 and rotated. The male thread of the shaft portion 72 of the fixing member 7 is thereby screwed into the female thread of the recessed portion 31. Then, when the fixing member 7 has been completely screwed in, the upper surface of the head portion 71 and the upper surface of the decoration member 6 are substantially level with each other. Attachment of the fixing member 7 and the decoration member 6 is thus completed, as shown in FIGS. 8 and 9.

5. FEATURES

According to the present embodiment, as described above, the following effects can be obtained.

(1) In the raised portion 30, the placement region 306 and the rear region 307 are formed in the face-back direction, and the rear region 307 inclines upward from the boundary 309 between both regions. Specifically, the two regions 306 and 307 are connected so as to bend at the boundary therebetween. For this reason, compared to when the two regions 306 and 307 are flatly connected, the rigidity of the raised portion 30 can be enhanced. The frequency of the vibration thereby increases when the ball is hit, and the pitch of the ball hitting sound can be raised. In particular, in the present embodiment, if the fixing member 7 and the decoration member 6 that function as weights are arranged in the vicinity of the antinode of vibration in the raised portion 30, the frequency of the vibration tends to decrease. Accordingly, such a structure is particularly advantageous in that, when an angle is given to the boundary 309 between the placement region 306 and the rear region 307 as described above, the rigidity of the raised portion that receives the vibration caused by hitting the ball is enhanced, and the pitch of the ball hitting sound can be raised.

(2) The raised portion 30 protruding downward is formed on the sole portion 3, and thus the position of the center of gravity of the head 10 can be lowered. In particular, because the recessed portion 31 to which the fixing member 7 and the decoration member 6 that function as weights are attached is formed inside the raised portion 30, the center of gravity of the head can be further lowered. The hitting angle can thereby be increased and the flight distance can be lengthened. Also, the fixing member 7 and the decoration member 6 can be prevented from protruding by being arranged inside the raised portion 30, and thus these members can be prevented from catching on the ground when the club is swung.

(3) The center of the recessed portion 31 is further to the back side in the face-back direction than the center of gravity of the head, and thus the depth of the center of gravity is increased. Furthermore, because the recessed portion 31 is arranged on the heel side in the toe-heel direction, slicing is less likely to occur (so-called "ball holding" improves). Slicing can also be suppressed due to the raised portion 30 being formed to have a triangular shape as described above and being mainly arranged on the heel side of the sole portion 3.

(4) Even if the recessed portion 31 is arranged further to the back side, in arranging the recessed portion 31 inside the raised portion 30, the recessed portion 31 can be housed inside the raised portion 30 due to the second edge portion 302 of the raised portion 30 protruding in an arc shape (protruding portion 304). Accordingly, the recessed portion 31 can be arranged on the back side, without impairing the design of the raised portion 30.

(5) The fixing member 7 and the decoration member 6 are both arranged in the recessed portion 31, and therefore the decoration member 6 can also be used as a weight.

6. VARIATIONS

Although an embodiment of the present invention has been described above, the present invention is not limited to the foregoing embodiment, and various modifications can be made without departing from the gist of the invention. Note that following modifications can be combined as appropriate.

6.1

In the above embodiment, the placement region 306 and the rear region 307 are both formed to have a flat shape, but need not be strictly flat, and may be slightly curved. Also, as long as the placement region 306 is flat at least in the face-back direction, the placement region 306 may curve in the toe-heel direction. Also, the shape and size of the placement region 306 and the rear region 307 are not particularly limited.

6.2

In the above embodiment, the raised portion 30 is formed to have a triangular shape, but the shape of the raised portion 30 is not particularly limited to this shape, as long as the recessed portion 31 is arranged inside the raised portion 30, and the center of the recessed portion 31 is arranged further to the back side in the face-back direction and to the heel side in the toe-heel direction than the center of gravity of the head. Also, the height of the rise in the raised portion 30 is not particularly limited, and as described in the aforementioned embodiment, the height of the rise may be changed depending on location or set to a constant height in all places. It is preferable, however, for the raised portion 30 to be arranged on the heel side as a whole. Note that, in the above embodiment, the raised portion 30 is formed by the region including the placement region 306 and the rear region 307 integrally protruding downward, but at least a part of placement region 306 and the rear region 307 need only be included in the raised portion 30. Also, the raised portion 30 is not necessarily required, and the placement region 306 and the rear region 307 can also be provided in a sole portion 3 that does not have a raised portion.

6.3

In the aforementioned embodiment, both the fixing member 7 and the decoration member 6 are arranged in the recessed portion 31, but the golf club head according to the present invention can be constituted even if only the fixing member 7 is arranged in the recessed portion 31, or even if neither the fixing member 7 nor the decoration member 6 is arranged in the recessed portion 31. Also, a plurality of recessed portions can be provided. Furthermore, the fixing member 7 and the decoration member 6 are not particularly limited in shape or fixing method, as long as they do not extend outside the recessed portion 31. Also, the recessed portion 31 may be other than circular, and may have a polygonal shape. Furthermore, the recessed portion 31 need only be arranged in the raised portion 30, and thus is not necessarily required to protrude from a peripheral portion.

6.4

In the above embodiment, a wood-type golf club was described, with this including a driver, a fairway wood, a utility and the like.

WORKING EXAMPLE

Hereinafter, a working example of the present invention will be described. The present invention is, however, not limited to the following working example.

(1) Preparation of Working Example and Comparative Example

Figure 10:
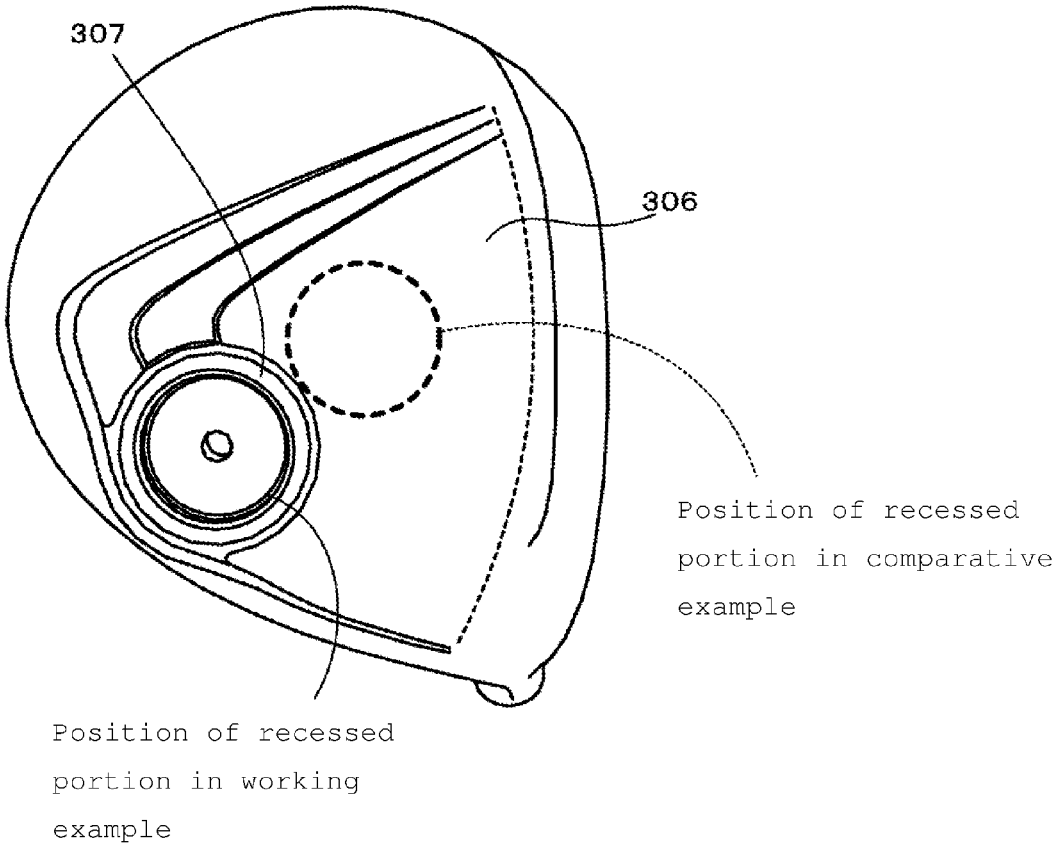
FIG. 10 is a bottom view of a golf club head showing a working example and a comparative example.

Here, golf club heads (drivers (#1)) according to a working example and a comparative example that differed in the shape of the sole portion were produced. The working example was a golf club head including the configuration shown in FIGS. 1 to 9 according to the above embodiment, and the angle formed by the placement region and the rear region was 7°. Also, the working example and the comparative example differed in the location of the recessed portion, as shown in FIG. 10. To be more specific, the comparative example differed from the working example in that the recessed portion substantially overlapped the placement region 306 and was not arranged in the rear region 307. Also, in the comparative example, the placement region 306 and the rear region 307 were flat and did not intersect. The remaining configuration was the same. As for the remaining configuration, the respective heads according to the working example and the comparative example had a two-piece structure formed by laser welding a head main body consisting of a lost wax precision casting part made of Ti-6Al-4V and a cup-shaped face member consisting of a hot forged part made of TIX 51AF produced by Nippon Steel & Sumitomo Metal Corporation. Head volume was 460 $cm^3$ and head mass was 196 g. Also, the face portion had a width in the toe-heel direction of 104 mm and a height in the up-down direction of 48 mm.

(2) Testing Relating to Ball Hitting Sound

First, 45-inch wood-type golf clubs were manufactured by mounting the same shaft (MP800, Dunlop Sports Co. Ltd.) in the heads according to the working example and the comparative example described above. Also, the fixing member and the decoration member (7.3 g in total) shown in the above embodiment were arranged in the recessed portion of the working example and the comparative example. Next, twenty golfers having handicaps from 5 to 15 hit golf balls (DDH TOUR SPECIAL, Dunlop Sports Co., Ltd.) with each club, and each ball hitting sound was collected using a sound level meter. Frequency response functions were derived from the collected ball hitting sounds using an FFT analyzer and the like (CF-4220 and analysis software "Graduo", Ono Sokki Co., Ltd.). The results were as follows.

Working example: 3825 Hz

Comparative example: 3040 Hz

Thus, with the working example, a ball hitting sound in a pleasing frequency band (range of approx. 3500-4500 Hz is preferable) was realized. In contrast, with the comparative example, the frequency was slightly low, resulting in a dull ball hitting sound. One possible cause of this lower frequency is the provision of heavy weights (fixing member and decoration member) in the placement region, which is where the antinode of the vibration is located when the ball is hit.

REFERENCE SIGNS LIST

1 Face portion
2 Crown portion
3 Sole portion
306 Placement region
307 Rear region
31 Recessed portion
6 Decoration member
7 Fixing member (weight member)

The invention claimed is:

1. A golf club head comprising:

a crown portion;

a face portion;

a sole portion having at least one recessed portion;

a hosel portion having an insertion hole for insertion of a shaft; and a weight member disposed in said recessed portion, wherein a reference state is defined as a state in which a central axis of the insertion hole is in a reference perpendicular plane that is configured to be perpendicular to a placement surface receiving the golf club head having a predetermined lie angle and loft angle, wherein a face-back direction is a direction that is perpendicular to a toe-heel direction and parallel to the placement surface, the toe-heel direction is a direction of a line of intersection of the reference perpendicular plane and the placement surface, wherein a heel side is a side on which the hosel portion is placed, a toe side is an opposite side to the heel side, a face side is a side on which the face portion is placed, a back side is a side opposite to the face side, wherein in the reference state, a placement surface side on which the sole portion is placed is a down side, a side opposite to the placement surface side is an up side, wherein the sole portion includes:

a placement region connected to the face portion, and to be at least partially placed on the placement surface in the reference state; and a rear region arranged further to the back side in the face-back direction than the placement region, and in which the recessed portion is arranged, wherein the rear region inclines upward relative to the placement region toward the back side, wherein the placement region and the rear region are formed in a raised portion, the raised portion protruding outwardly from an exterior surface of the sole portion, the exterior surface of the sole portion being spaced from the at least one recessed portion of the sole portion, and wherein the raised portion comprises:

a first edge portion that extends from the toe side to a vicinity of the hosel portion along a vicinity of a boundary between the face portion and the sole portion, a second edge portion that extends from an edge of the first edge portion that is in a vicinity of the hosel portion to the vicinity of a midpoint in the toe-heel direction, along a vicinity of a boundary between the crown portion and the sole portion, a third edge portion that joins an end portion of the first edge portion on the toe side and an end portion of the second edge portion on the toe side, a first step is a step from the first edge portion to a region in an exterior surface of the sole portion adjacent the first edge portion, a second step is a step from the second edge portion to a region in the exterior surface of the sole portion adjacent the second edge portion, a third step is a step from the third edge portion to a region in the exterior surface of the sole portion adjacent the third edge portion, and the second step is bigger than the first step and the third step is bigger than the first step, and wherein a boundary between the placement region and the rear region is formed along a peripheral edge of the recessed portion.

2. The golf club head according to claim 1, wherein the rear region inclines at an angle of 4 to 10 degrees relative to the placement region.

3. The golf club head according to claim 1, wherein at least a part of the placement region and the rear region integrally protrude towards a down side.

4. The golf club head according to claim 1, wherein the placement region is formed to have a flat shape.

5. The golf club head according to claim 1, wherein the recessed portion is arranged further to the back side and to the heel side in the toe-heel direction than a center of gravity of the golf club head.

6. The golf club head according to claim 1, wherein the recessed portion has a bottom surface, the recessed portion has a fixing hole, at a center of the bottom surface, whose size is smaller than that of the recessed portion and that extends inward from the sole portion, wherein the weight member has a shaft portion, and wherein the shaft portion of the weight member is fitted in the fixing hole.

7. The golf club head according to claim 6, wherein the weight member further has a head portion whose diameter is bigger than that of the shaft portion, and wherein the head portion of the weight member is arranged on the bottom surface of the recessed portion.

8. The golf club head according to claim 1, further comprising: a decoration member arranged in the recessed portion, wherein the decoration member is fixed in the recessed portion by the weight member.

9. The golf club head according to claim 8, wherein, in a plane view, the decoration member is bigger than the weight member and has a step portion that houses the head portion of the weight member at the center thereof, and wherein the head portion of the weight member is housed in the step portion of the decoration member.

10. The golf club head according to claim 9, wherein an exposure surface of the head portion of the weight member and an exposure surface of the decoration member are arranged on the same plane.

11. The golf club head according to claim 10, wherein an exposure surface of the weight member and the exposure surface of the decoration member coincide with an exposure surface of the sole portion or are positioned inside the exposure surface of the sole portion.

12. The golf club head according to claim 7, further comprising: a decoration member that is to be arranged at the bottom surface of the recessed portion, in a plane view, wherein the decoration member is bigger than the weight member and has a step portion that houses the head portion of the weight member at the center thereof and a through hole at the center thereof, and wherein the decoration member is fixed at the bottom surface of the recessed portion by the head portion of the weight member being housed in the step portion of the decoration member and the shaft portion of the weight member being fitted in the through hole of the decoration member and the fixing hole of the recessed portion.

13. The golf club head according to claim 1, wherein, in a plane view of the sole portion, the recessed portion is formed to have circular shape.

14. The golf club head according to claim 13, wherein, in a plane view of the sole portion, the weight member is formed to have circular shape along the recessed portion.

* * * * *